United States Patent [19]

Aebi

[11] 3,960,258

[45] June 1, 1976

[54] TYPEWRITER MECHANISM FOR AUTOMATICALLY LOADING AND EJECTING PAPER

[75] Inventor: Otto Aebi, Yverdon, Switzerland

[73] Assignee: Hermes Precisa International S.A., Yverdon, Switzerland

[22] Filed: Nov. 20, 1974

[21] Appl. No.: 525,627

[30] Foreign Application Priority Data

Nov. 22, 1973 Switzerland ..... 16451/73

[52] U.S. Cl. ..... 197/127 R

[51] Int. Cl.[2] ..... B41J 13/03

[58] Field of Search ..... 197/127 R, 133 R

[56] References Cited

UNITED STATES PATENTS

| | | | |
|---|---|---|---|
| 2,204,243 | 6/1940 | Anderson | 197/127 R |
| 2,353,407 | 7/1944 | Kurowski | 197/127 R |
| 3,276,562 | 10/1966 | Mathews | 197/127 R |

*Primary Examiner*—Anton O. Oechsle

*Attorney, Agent, or Firm*—Emory L. Groff, Jr.

[57] ABSTRACT

The typist sets a scale to the desired length of paper to be introduced, thereby determining the angle through which a toothed third wheel rotates. Depression of the automatic loading key opens the paper bail and couples the third wheel to a driven toothed first wheel and to a toothed second wheel, which latter turns the platen. The third wheel turns until a finger thereon operates on mechanical linkage to uncouple the three wheels and disconnect the first wheel from the motor. When the automatic ejection key is depressed, the second wheel is meshed with the first wheel, which is coupled to the motor as long as the key is held down, thereby rotating the platen.

11 Claims, 6 Drawing Figures

17
15d
16d
28
16g
II
15g
60
59
59
F3
F2
53
57
56
49
49
45
49
64
66
47
48
39
46
65
82
22
23
21
20
II
24
29
18
19
2
61
63

84
49
50
54
51
55
56
60
53
44
52
42
41
36
34'
5
34

F1
5
8
9
10
11
12
13
45
47
48
49
56
63
64
65
66
67
68
69
70
71
72
73
74
75
76
77
78
79
80
81
82
83
84

TYPEWRITER MECHANISM FOR AUTOMATICALLY LOADING AND EJECTING PAPER

The invention relates to a mechanism, in a typewriter, particularly one having a type head, for automatically loading and ejecting the paper. The typewriter incorporates an electric motor, a platen, means for rotating the latter, adjusting means for setting, depending on the length of paper that is to be loaded into the typewriter, the amount of angular movement of the platen, and a paper bail.

Mechanisms for automatically loading and ejecting paper in a typewriter are well known. Automatic loading enables the typist to move the paper quickly and accurately, with respect to the upper edge, to the desired first line of typing. Known typewriters incorporate a hand lever, usually located on the right side, the operation of which permits automatic paper loading. The amount that the platen rotates is set by the typist, who moves a slider along a scale.

An object of the invention is an improved mechanism that simplifies the automatic introduction and removal of paper from a typewriter.

In accordance with the invention, this object is attained by having, as part of the means for rotating the platen, a first control arrangement for continuously rotating the platen to eject paper from the typewriter, and a second control arrangement for rotating the platen for a limited period of time in dependence on the position of the adjusting means for setting the length of paper to be loaded, so as to introduce automatically the desired length of paper into the typewriter. The stated object is also attained by providing respective actuating means for rendering the first or second control arrangement operative, and by providing means that cooperate with the second control arrangement and are controlled thereby for opening the paper bail whenever the second control arrangement is operative.

The accompanying drawings illustrate diagrammatically and by way of example the preferred embodiment of the invention. In said drawings.

Figure 1:
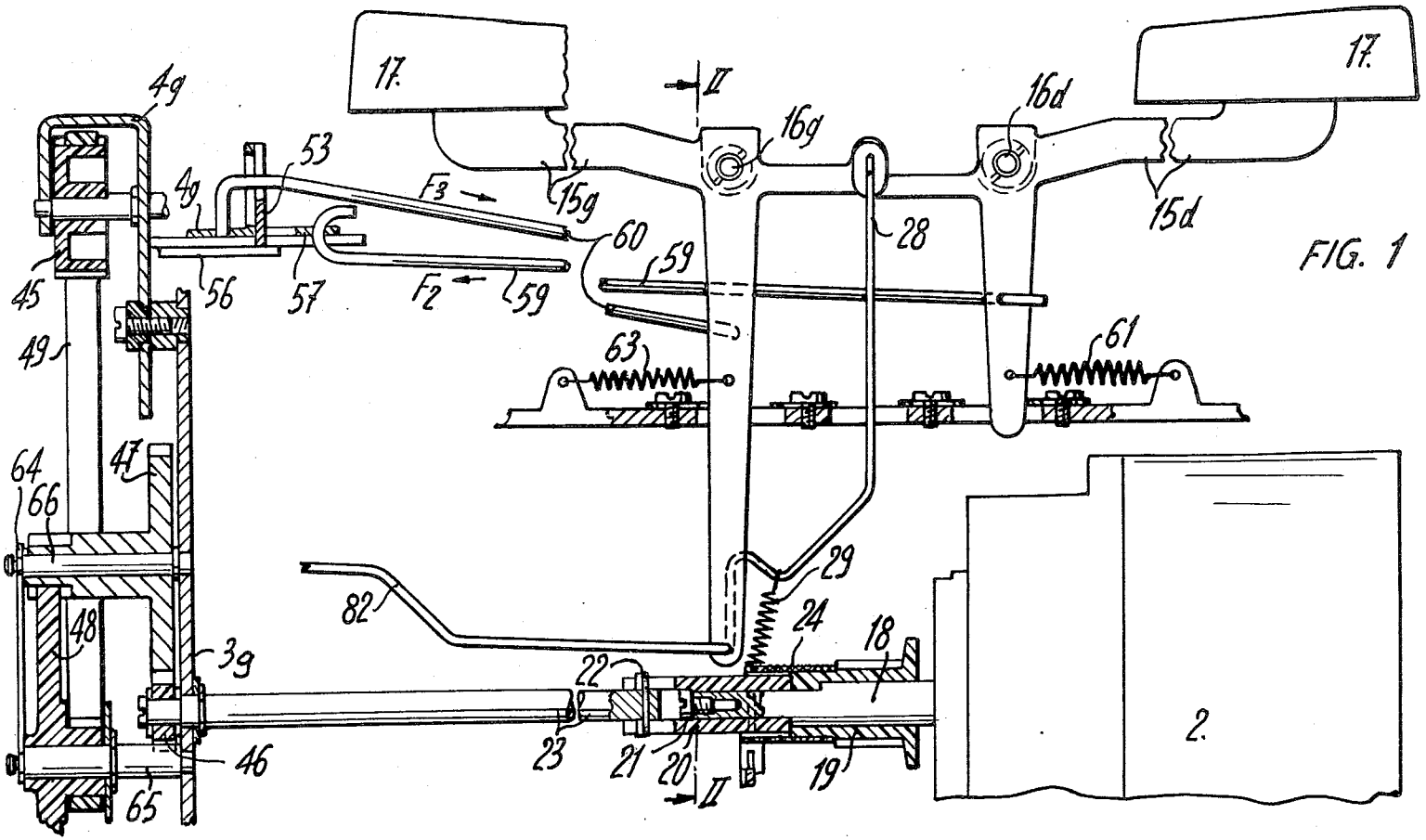
FIG. 1 is a side view, partly in section, of the mechanism of the invention.
Figure 2:
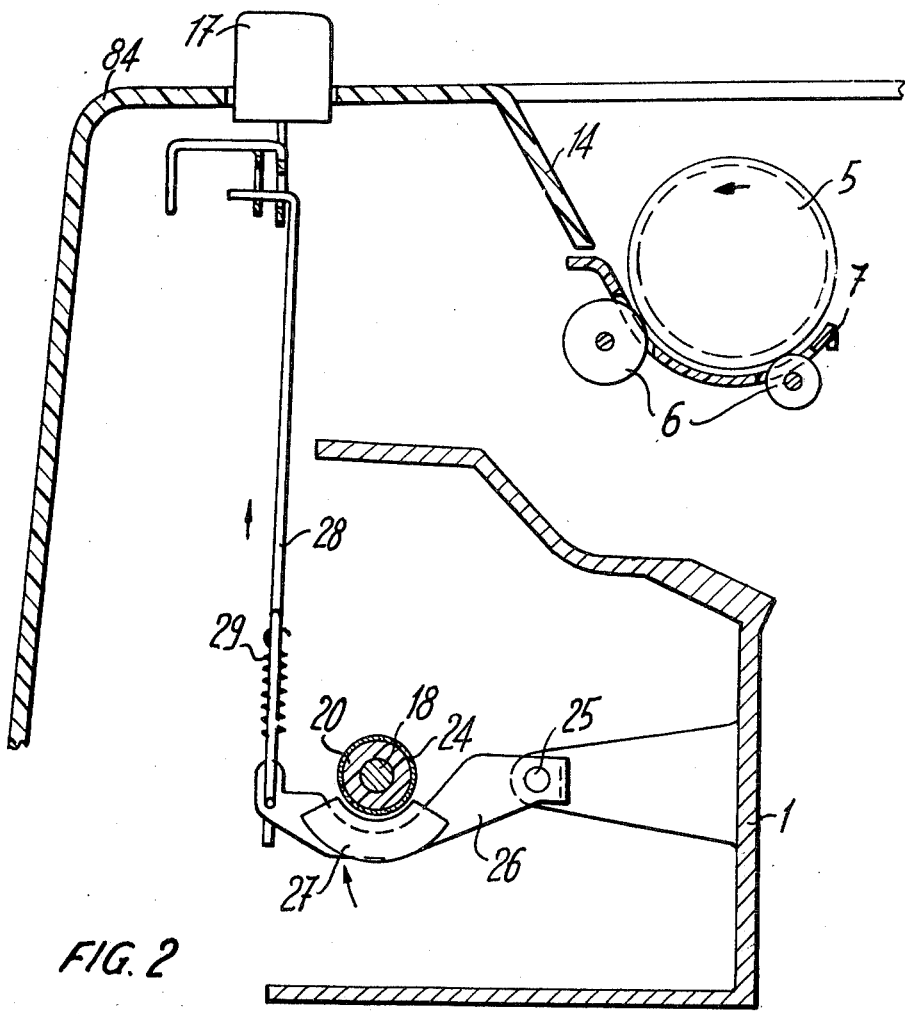
FIG. 2 is a sectional view, taken along line II—II of FIG. 1.
Figures 5, 6:
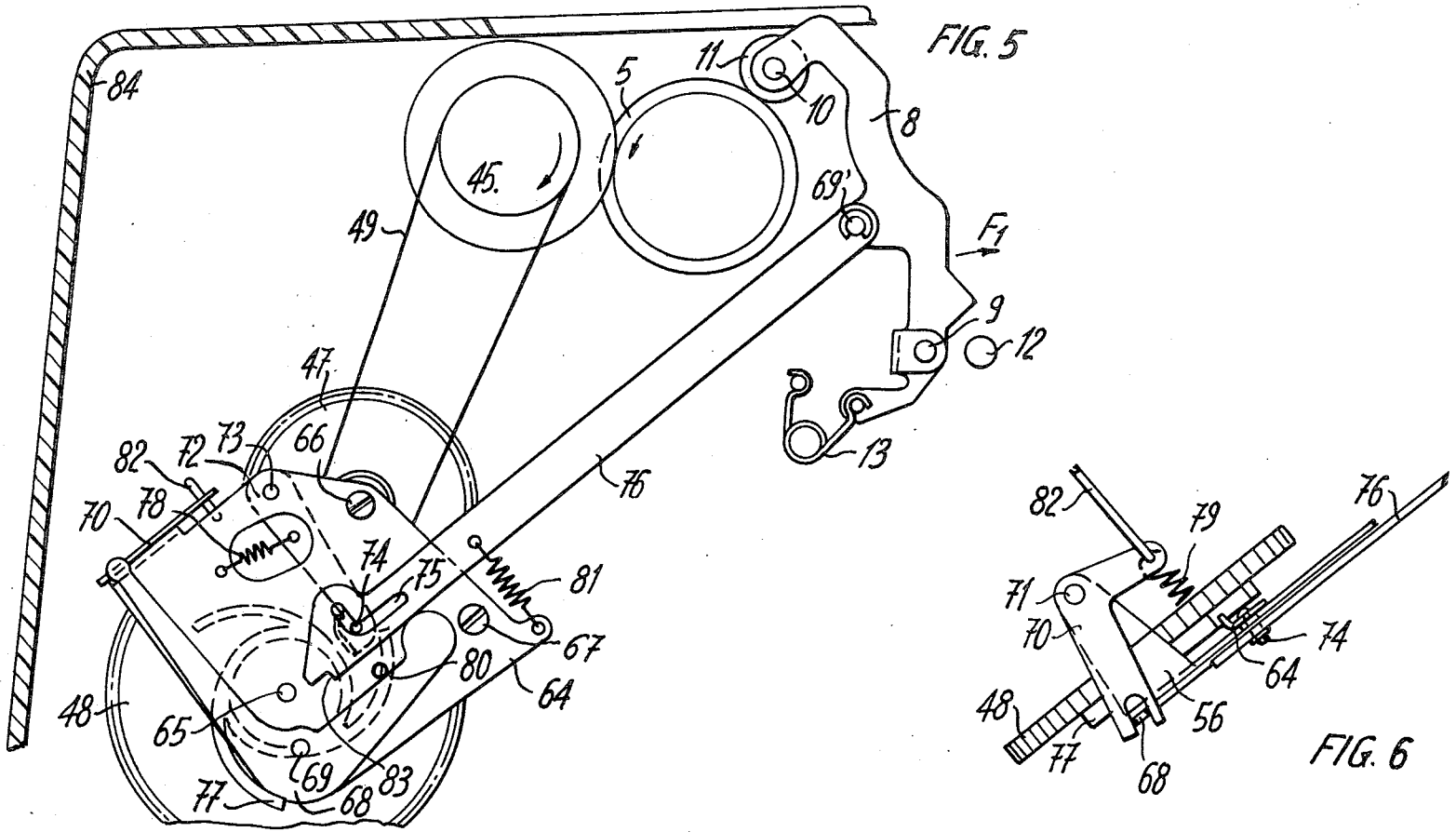
FIG. 5 is an end view of the left part of FIG. 1.
FIG. 6 is a side view of part of the arrangement shown in FIG. 5.

With reference to the drawings, the mechanism for automatically loading and ejecting the paper is mounted on a typewriter having a type head, not shown, and comprising a housing 1, FIG. 2, that supports an electric motor 2. The typewriter also has left and right side walls 3*g*, FIGS. 1 and 3, and 3*d* respectively, which respectively support the walls 4*g* and 4*d*, the walls 3*d* and 4*d* not being visible in the figures. The platen 5 is pivotally mounted in these latter two walls. The platen is provided with a conventional paper feed for introducing the one or more sheets of paper, not shown. Referring to FIG. 5, the feed comprises, in a known manner, feed or pressure rollers 6 and a paper pan 7, as well as a paper bail having two arms 8 (of which only the left arm is visible in FIG. 5) that are pivotally mounted at 9 in the left and right walls 3*g* and 3*d*. The arms 8 are connected together by a bar 10. Paper bail rolls 11, which hold the paper in place and help to feed it, are rotatably mounted on this arm.

The paper bail can be opened by pivoting it in the direction of the arrow F1, FIG. 5, until it comes to rest against a stop 12. The paper bail is held closed by a spring 13.

The typewriter also has a cover 84 that forms at 14 a paper table for supporting the paper, as shown in FIG. 2.

With reference to FIG. 1, located behind the platen 5 are two control levers 15*g* and 15*d*, positioned respectively on the left and right sides of the typewriter. Each of these two levers carries a key 17 and is free to turn on respective pivots 16*g* and 16*d* against the force of respective springs 63 and 61. These pivots are fixed in the housing 1.

A bushing 19 is rigidly fixed on the shaft 18 of the motor 2. A further bushing 20, held in place by a screw 21, is mounted on the end of this shaft and is free to rotate with respect thereto. The end of the bushing 20 has a slot for a pin 22 for turning a secondary shaft 23. The latter, held by the bushing 20, rotates in the left wall 3*g* of the typewriter. A coupling spring 24, fixedly mounted on the bushing 19, rotates freely about the bushing 20. With reference to FIG. 2, a shoe 27, which can be pressed against the coupling spring 24, is mounted on a support 26 that pivots on a pin 25 carried by the housing 1. The support 26 is connected to the control levers 15*g* and 15*d* by means of a vertical rod 28 and a spring 29.

Figure 3:
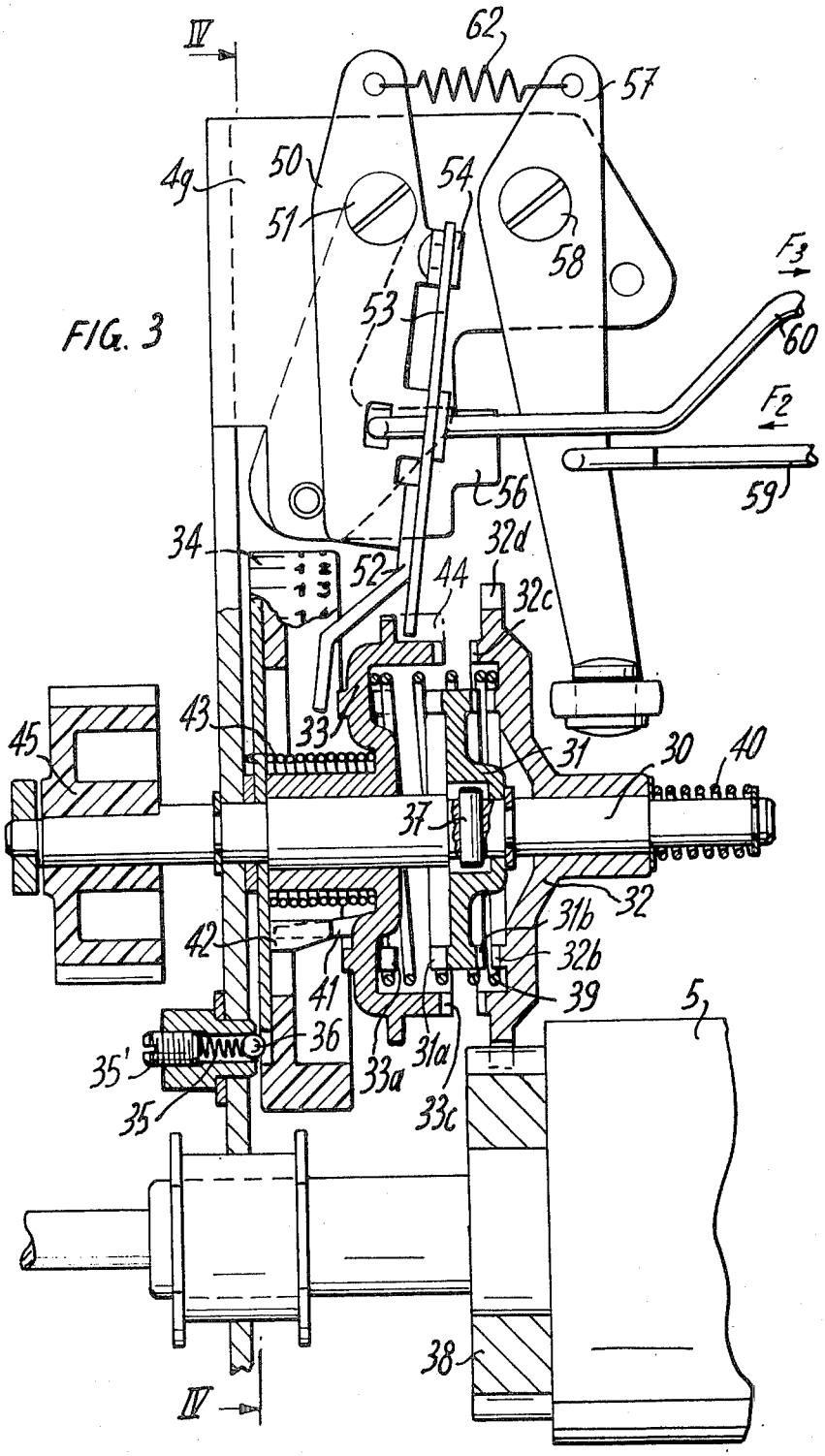
FIG. 3 is a top view, on expanded scale, of a detail from the left part of FIG. 1.

The arrangement for turning the platen 5, which is shown in detail in FIG. 3, is mounted on the left side wall 4*g* of the typewriter. The arrangement comprises a shaft 30 that is rotatably mounted in the wall 4*g* and extends parallel to the platen 5. The shaft carrier three toothed wheels: a central toothed wheel 31, which a pin 37 fixes rigidly to the shaft, and two toothed wheels 32 and 33 that can be moved lengthwise on the shaft and that are free to rotate thereon.

The central wheel 31 has two toothed rims: a first toothed rim 31*a* on one face, which can engage an interior toothed ring 33*a* incorporated in the wheel 33, and a second toothed rim 31*b* on the other face, which can engage an interior toothed ring 32*b* of the wheel 32.

The wheel 33 also has an outer toothed ring, or rim, 33*c*, which can mesh with an outer toothed ring, or rim, 32*c* on the wheel 32. The wheel 32 also incorporates external gear teeth 32*d*, which are meshed with a toothed wheel 38 that is rigidly fixed to the platen 5.

Figure 4:
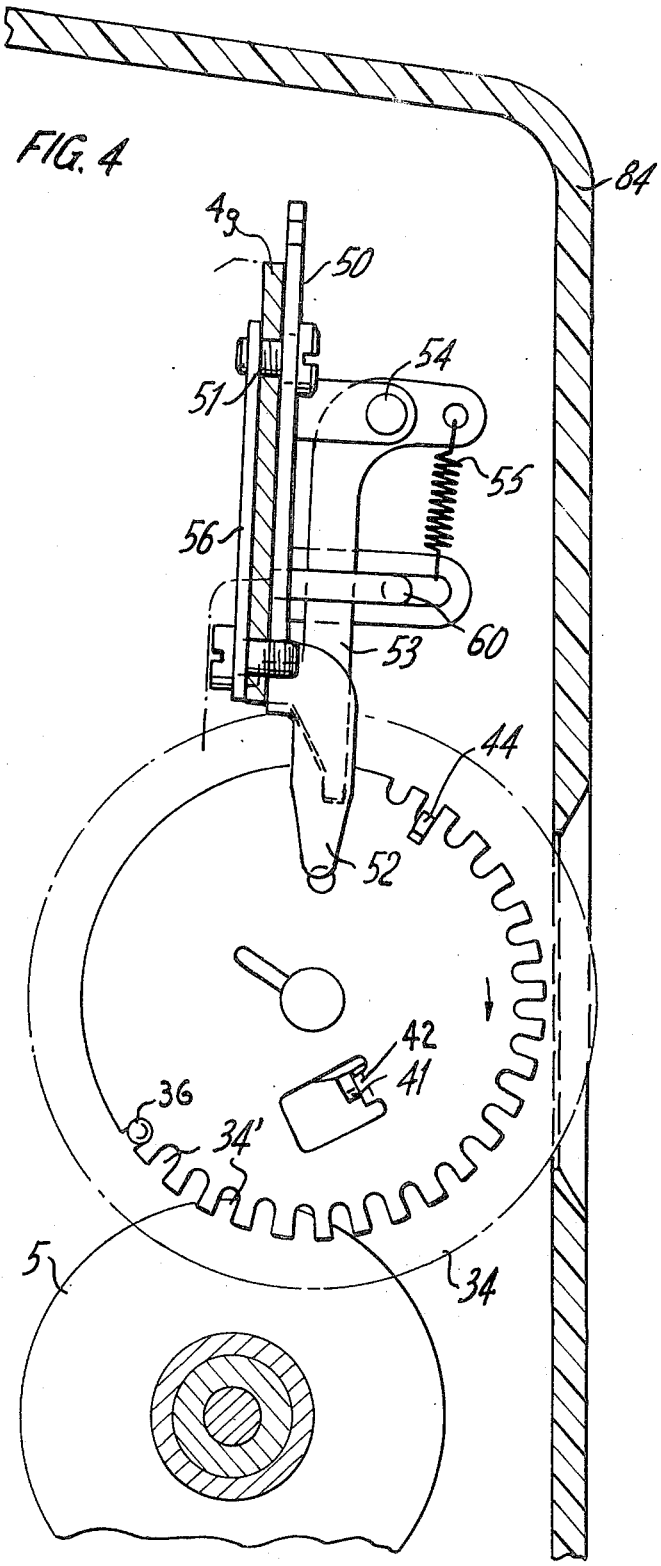
FIG. 4 is a sectional view, taken along line IV—IV of FIG. 3.

The shaft 30 also carries a selector 34, illustrated in both FIGS. 3 and 4, which consists of a disc mounted to turn freely on the shaft and having a graduated peripheral drum. The drum scale enables the typist to choose the desired position of the selector and thereby to determine the angular movement of the platen 5, which movement corresponds to the length of the paper to be introduced. The selector is positioned in a known manner, owing to a series of slots 34' incorporated in the circumference of the selector disc. A ball 36, which is biased by a compression spring 35 held in place by a screw 35', engages these slots. A compression spring 39 holds apart the wheels 32 and 33. Another compression spring 40, mounted on the right end of the shaft 30, and stronger than the spring 39, positions the wheel 32.

The wheel 33 can be made rotationally rigid with respect to the selector 34 by means of a spline 41 that is incorporated in the rear face of the wheel 33, the front face of the latter having the teeth 33*a* and 33*c*. A torsion spring 43 presses the spline against a stop 42 of the selector 34. Consequently, when the typist turns the selector to a position, both the selector 34 and the wheel 33 turn on the shaft 30.

The shaft 30 is driven by the shaft 23 by means of toothed wheels 46, 47 and 48, and by a ribbed drive belt 49 that engages a slotted wheel 45, which latter turns the shaft 30. The motor shaft 18 can be drivingly connected to the shaft 23 by the coupling spring 24.

A lever 50 is pivotally mounted at 51 on the wall 4*g*. At its lower end, the lever has an arm 52 that can push against the wheel 33 to move the latter along the shaft 30. The lever 50 is operated by a rod 60 connected to the lever 15*g*, which carries the key 17 that is located on the left side of the typewriter. Another arm 57 is pivotally mounted at 58 on the wall 4*g*. This arm can be pushed against the wheel 32 to move it along the shaft 30. The arm 57 is operated by a rod 59 connected to the lever 15*d* carrying the key 17 that is located on the right side of the typewriter. A blade 53, FIGS. 1, 3 and 4, is pivotally mounted at 54 on the lever 50. A spring 55 holds the blade against a plate 56 fixed to the wall 4*g*. The free end of the blade 53 can be moved by a finger 44 provided on the circumference of the wheel 33. The lever 50 is held in the rest position by a return spring 62.

To facilitate the introduction of the paper, a paper release is mounted on the wall 3*g*. The paper release opens the paper bail, so that the paper can slide freely between the platen 5 and the paper bail rolls 11, and then closes the paper bail, once the paper is inserted.

The paper release, which is illustrated in FIGS. 5 and 6, is mounted on a plate 64 connected to rotating the wall 3*g* by the axles 65 and 66 of the toothed wheels 47 and 48 and by a screw 67. A squarish lever 68 is pivotally mounted at 69 on the plate 64. One arm of the lever 68 bears on a push rod 76 connected to the left arm 8 of the paper bail by a pivot 69'. The other arm of the lever 68 cooperates with a lever 70 likewise pivotally mounted, at 71, on the plate 64. By means of a rod 82, the lever 70 is controlled by the key 17 of the lever 15*g*.

The plate 64 also carries an arm 72, pivotally mounted at 73, which arm has a pin 74 that engages a right angled slot 75 incorporated in the push rod 76. The wheel 48 carries a three arm cam 77. A spring 78 pushes the arm 72 against one of the three cam arms. A spring 79, acting on the lever 70, pushes the lever 68 against a stop 80 fixed to the plate 64. Another spring 81 presses the push rod 76 against the right arm (as seen in FIG. 5) of the lever 68, with a force less than that which holds the lever 68 against the stop 80.

The mechanism described operates in the following manner:

When the typist depresses the key 17 of the right control lever 15*d*, the latter turns about the pivot 16*d* against the bias of the spring 61, thereby moving the rod 28 and the spring 29, so that the support 26 pivots, raising and pressing the shoe 27 against the coupling spring 24. The latter, rotated by the bushing 19, which is fixed on the motor shaft 18, grips the bushing 20, rotating the latter and, consequently, rotating the secondary shaft 23 by means of the pin 22. The shaft 30 is rotated by the toothed wheels 46, 47 and 48, by the ribbed drive belt 49, and by the slotted wheel 45. Consequently, the central toothed wheel 31 is also driven.

The pivotal movement of the lever 15*d* also shifts the rod 59 in the direction of the arrow F2, as shown in FIGS. 1 and 3. The rod 59, which controls the arm 57, thus causes the latter to pivot about 58 in a clockwise sense and to strike the wheel 32 and to push it along the shaft 30 until the interior toothed ring 32*b* meshes with the toothed rim 31*b* of the wheel 31. The wheel 31 now drives the wheel 32, which rotates the platen 5 by means of the wheel 38. The platen continues to rotate for as long as the key 17 of the lever 15*d* is depressed. In these conditions, a sheet of paper that was inserted around the platen 5 is ejected. It is apparent that the lever 15*d* operates a first control arrangement causing the continuous rotation of the platen. In other words, the first control arrangement, when operated, ejects the paper. As soon as the typist releases the key 17 of the lever 15*d*, the spring 61 pulls this lever back to its rest position, the coupling spring 24 is released, the connection between the shafts 18 and 23 is broken, and the platen 5 stops.

When the typist depresses the key 17 of the left lever 15*g*, the latter turns about the pivot 16*g* against the bias of the spring 63, thereby shifting the rod 28 in the same way as when the lever 15*d* was depressed, so that the shaft 30 and the wheel 31 are driven just as before. At the same time, the rod 60 is moved in the direction of the arrow $F_3$, FIGS. 1 and 3, and, as it moves, causes the lever 50 to pivot at 51. The arm 52 of this lever pushes against the wheel 33 causing it to slide along the shaft 30. First, the wheel 33 meshes with the wheel 32 (by means of the toothed rings 33*c* and 32*c*); and next, pushing on the wheel 32 and compressing the spring 40, it meshes with the central wheel 31. The latter drives the wheel 33, which, in turn, rotates the wheel 32, which rotates the platen 5 through the wheel 38. When the blade 53 arrives at the end of the plate 56, which latter supports the blade, the spring 55 causes the blade to fall and to lock the left key 17 in the depressed position. Once the blade has fallen, the typist can release the key.

The platen continues to rotate until the finger 44 of the wheel 33 strikes the blade 53 and raises it. The spring 62 returns the lever 50 and the blade, which latter is no longer pressed against the plate 56, to their home positions. When the finger 44 raises the blade 53, the lever 15*g* is unlocked and free to return to its rest position under the bias of the spring 63. At the same time, the spring 39 is now able to disengage the wheel 33 from the wheels 31 and 32, as the arm 52 no longer pushes on the wheel 33. The platen 5 stops rotating. The torsion spring 43 rotates the wheel 33 in the direction opposite to that in which it was driven until the spline 41 strikes the stop 42 of the selector 34. The entire mechanism is once again in its state of rest.

When the typist turns the selector 34 to the desired position, the selector, turning on the shaft 30, rotates the wheel 33, so that the finger 44, before it can strike the blade 53, must move through a path the length of which depends on the setting of the selector. In this way is determined the length of time that the platen 5 is rotated and consequently the length of paper that is loaded. It is apparent that the lever 15*g* consequently operates a second control arrangement that controls, depending on the setting of the selector 34, just how long the platen 5 will rotate and, consequently, how great a length of the sheet of paper will be loaded.

The arrangement described for loading the paper is synchronized with the mechanism for opening the paper bail, which mechanism operates in the following manner:

When the typist, by depressing the left key 17, operates the lever 15*g* so as to introduce paper, the wheel 48 imparts a reciprocal movement to the arm 72 by means of the cam 77, FIGS. 5 and 6. The lever 15*g* frees the lever 68 by means of the rod 82 and the lever 70. As soon as the pin 74 of the arm 72, as the latter reciprocates, is positioned so that it can enter the upwardly extending leftward branch of the slot 75, the spring 81 pulls the push rod 76 against the stop 80. The pin 74 now drives the push rod upwards, opening the paper bail. When an arm of the cam 77 slips out from underneath the pin 74, the spring 81 pulls the push rod 76 towards the stop 80, where the step 83 engages the latter; and the paper bail is prevented from closing. At the end of the operation, because the lever 15*g* is free, as already explained, the lever 68, urged by the spring 79, returns to the home position, thereby pushing the push rod 76 until the pin 74 is positioned at the lower end of the upwardly extending righthand branch of the slot 75; whereupon, the spring 13 closes the paper bail against the platen 5.

Although the invention has been particularly shown and described with reference to the preferred embodiment, those skilled in the art will understand that the invention admits of changes in form and detail without exceeding the spirit and scope of the invention.

I claim:

1. In a mechanism for automatically loading paper into and ejecting paper from a typewriter, said typewriter having an electric motor, a platen, means for rotating said platen, adjusting means under control of the typist for setting the amount of angular movement of said platen depending on the length of paper that is to be loaded into the typewriter, and a paper bail, the improvement wherein said means for rotating said platen comprises a first control means for continuously rotating said platen to eject paper from the typewriter, and a second control means for rotating said platen for a limited period of time depending on the setting of said adjusting means so as to automatically introduce the desired length of paper into the typewriter for typing, means cooperating with said second control means and controlled thereby for opening said paper bail whenever said second control means is operative, actuating means for selectively rendering said first or second control means operative, said means for rotating said platen further including first toothed wheel means, a rotatable shaft on which said first toothed wheel means is rotationally rigidly mounted, said electric motor including a drive shaft, means for drivingly coupling said drive shaft to said rotatable shaft to rotate the latter whenever said first or second control means is operative, said first control means including second toothed wheel means, said second control means including third toothed wheel means, said first control means including connecting means for meshing said first and second toothed wheel means whenever said first control means is operative, said second control means including connecting means for meshing said first, second and third toothed wheel means whenever said second control means is operative, said second and third toothed wheel means mounted on said rotatable shaft and free to rotate thereon and to move lengthwise therealong, and said second toothed wheel means being drivingly connected to said platen to rotate the latter.

2. The mechanism as defined in claim 1, wherein said first, second and third toothed wheel means are cooperatively associated on said rotatable shaft, and wherein said connecting means of said first control means includes means for moving said second toothed wheel means lengthwise along said rotatable shaft to mesh the former with said first toothed wheel means whenever said first control means is operative, whereby said second toothed wheel means, and thereby said platen, are rotated; and first resilient means for normally holding said second toothed wheel means spaced from said first toothed wheel means.

3. The mechanism defined in claim 2, wherein said connecting means of said second control means includes means for moving said third toothed wheel means lengthwise on said rotatable shaft to mesh with said first and second toothed wheel means whenever said second control means is operative, whereby said second and third toothed wheel means, and thereby said platen, are rotated, said first resilient means also normally holding said third toothed wheel means spaced from said first and second toothed wheel means.

4. The mechanism as defined in claim 3, wherein said adjusting means is mounted on said rotatable shaft free to be turned thereon by the typist to the desired setting; and first coupling means for so interconnecting said adjusting means and said third toothed wheel means when said adjusting means is turned that when the latter is turned to the desired setting said third toothed wheel means is rotated an amount dependent on the turning of said adjusting means.

5. The mechanism as defined in claim 4, further including second coupling means for so interconnecting said third toothed wheel means and said adjusting means as to permit relative rotation therebetween when the former meshes with said first and second toothed wheel means and is driven and as to return said third toothed wheel means to its original position as determined by the setting of said adjusting means when said second control means is not operative.

6. The mechanism as defined in claim 5, further including locking means for maintaining said second control means operative independent of said actuating means for rendering said second control means operative, once said actuating means has been actuated; and unlocking means associated with said third toothed wheel means and moving therewith for disengaging said locking means after said third toothed wheel means has rotated an amount corresponding to the required rotation of said platen as determined by the setting of said adjusting means, whereby the disengagement of said locking means renders said second control means inoperative.

7. The mechanism as defined in claim 6, wherein said unlocking means is associated with the circumference of said third toothed wheel means.

8. The mechanism as defined in claim 1, wherein said means for opening said paper bail includes control means for holding said paper bail closed whenever said first control means is operative, and for opening said paper bail whenever said second control means is operative.

9. The mechanism as defined in claim 8, wherein said bail control means includes movable link means connected to said paper bail for opening the latter when moved from a first position to a second position, and cam means driven by said electric motor whenever said first or second control means is operative for acting on said movable link means to move the latter from said first position to said second position whenever said second control means is operative.

10. The mechanism as defined in claim 9, wherein said bail control means further includes lever means for acting on said movable link means to hold the latter in said first position whenever said first control means is operative and for freeing said movable link means whenever said second control means is operative, pivotally mounted arm means positioned to be acted on by said cam means and moved thereby, second resilient means for moving said movable link means from said first position to an intermediate position when said lever means frees said movable link means, and means on said movable link means and means on said pivotally mounted arm means mutually cooperating for moving said movable link means from said intermediate position to said second position whenever said second control means is operative.

11. In a mechanism for automatically loading paper into and ejecting paper from a typewriter, said typewriter having an electric motor, a platen, means for rotating said platen, adjusting means under control of the typist for setting the amount of angular movement of said platen depending on the length of paper that is to be loaded into the typewriter, and a paper bail, the improvement wherein said means for rotating said platen comprises a first control means for continuously rotating said platen to eject paper from the typewriter, and a second control means for rotating said platen for a limited period of time depending on the setting of said adjusting means so as to automatically introduce the desired length of paper into the typewriter for typing, means cooperating with said second control means and controlled thereby for opening said paper bail whenever said second control means is operative, actuating means for selectively rendering said first or second control means operative, said means for rotating said platen further including first toothed wheel means, a rotatable shaft on which said first toothed wheel means is rotationally rigidly mounted, said electric motor including a drive shaft, means for drivingly coupling said drive shaft to said rotatable shaft to rotate the latter whenever said first or second control means is operative, said first control means including second toothed wheel means, said second control means including third toothed wheel means, said first control means including connecting means for meshing said first and second toothed wheel means whenever said first control means is operative, said second control means including connecting means for meshing said first, second and third toothed wheel means whenever said second control means is operative, said second toothed wheel means being drivingly connected to said platen to rotate the latter, said first and second control means capable of functioning independently of each other.

* * * * *